US008624816B2

(12) United States Patent
Ryu et al.

(10) Patent No.: US 8,624,816 B2
(45) Date of Patent: Jan. 7, 2014

(54) LIQUID CRYSTAL DISPLAY DEVICE AND METHOD OF DRIVING THE SAME

(75) Inventors: Jee-Youl Ryu, Yongin (KR); Yeon-Shil Jung, Yongin (KR); Deok-Jun Choi, Yongin (KR); Tae-Soo Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1062 days.

(21) Appl. No.: 12/501,179

(22) Filed: Jul. 10, 2009

(65) Prior Publication Data

US 2010/0013817 A1 Jan. 21, 2010

(30) Foreign Application Priority Data

Jul. 18, 2008 (KR) ..... 10-2008-0070001

(51) Int. Cl.
*G09G 5/00* (2006.01)

(52) U.S. Cl.
USPC ..... 345/98; 345/100

(58) Field of Classification Search
USPC ..... 345/87–90, 99, 101, 208, 211, 690–693
See application file for complete search history.

(56) References Cited

U.S. PATENT DOCUMENTS

| | | | | |
|---|---|---|---|---|
| 4,328,490 | A * | 5/1982 | Usuba et al. | 345/618 |
| 5,936,604 | A * | 8/1999 | Endou | 345/101 |
| 6,731,265 | B1 * | 5/2004 | Kokuhata et al. | 345/101 |
| 7,639,222 | B2 * | 12/2009 | Chen et al. | 345/87 |
| 7,969,399 | B2 * | 6/2011 | Hosotani | 345/98 |
| 2004/0041762 | A1 | 3/2004 | Naiki et al. | |
| 2006/0158415 | A1 | 7/2006 | Izumi | |
| 2006/0256065 | A1 * | 11/2006 | Jung | 345/100 |
| 2007/0285377 | A1 * | 12/2007 | Yamazaki | 345/101 |
| 2008/0018569 | A1 | 1/2008 | Sung et al. | |

FOREIGN PATENT DOCUMENTS

| | | | |
|---|---|---|---|
| CN | 1489124 | A | 4/2004 |
| CN | 1746962 | A | 3/2006 |
| CN | 1804986 | A | 7/2006 |
| CN | 101083065 | A | 12/2007 |
| JP | 05-080299 | | 4/1993 |
| KR | 10-2007-0058827 | | 6/2007 |
| KR | 10-2007-0071722 | A | 7/2007 |
| KR | 10-2007-0075795 | | 7/2007 |

OTHER PUBLICATIONS

Chinese Office action dated Jul. 6, 2012, issued in Chinese Patent Application No. 2009-10166936, 5 pages.

(Continued)

*Primary Examiner* — Amare Mengistu
*Assistant Examiner* — Stacy Khoo
(74) *Attorney, Agent, or Firm* — Christie, Parker & Hale, LLP

(57) ABSTRACT

A liquid crystal display device includes a display unit including a plurality of liquid crystal cells at crossing regions of a plurality of data lines and a plurality of gate lines, a source driver for supplying source voltages to the plurality of data lines, and a temperature sensor for sensing an ambient temperature and for outputting an temperature sensing signal corresponding to the ambient temperature, wherein the source driver includes a source amplifying register unit for controlling a rising slope of the source voltages in accordance with the temperature sensing signal.

11 Claims, 4 Drawing Sheets

(56) References Cited

OTHER PUBLICATIONS

KIPO Office action dated Nov. 25, 2009 for Korean priority application No. 10-2008-0070001, noting listed references in this IDS.
SIPO Office Action dated May 25, 2011, for corresponding Chinese patent application 200910166936.0, noting the listed reference in this IDS, 6 pages.
SIPO Certificate of Patent No. 1135993 for CN Application No. 200910166936, dated Feb. 13, 2013 (3 pages).
Taiwan Office action dated May 21, 2013, with English translation, for corresponding Taiwanese Patent application 098124063, (18 pages).

* cited by examiner

LIQUID CRYSTAL DISPLAY DEVICE AND METHOD OF DRIVING THE SAME

CROSS-REFERENCE TO RELATED APPLICATIONS

This application claims the benefit of Korean Patent Application No. 2008-0070001, filed on Jul. 18, 2008, in the Korean Intellectual Property Office, the entire content of which is incorporated herein by reference.

BACKGROUND

1. Field of the Invention

The present invention relates to a liquid crystal display device and a method of driving the same.

2. Discussion of Related Art

A liquid crystal display device is a flat panel display device having liquid crystal cells arranged in a matrix between an upper substrate and a lower substrate.

The liquid crystal display device forms an electric field by applying a source voltage and a common voltage to a pixel electrode and a common electrode, respectively, of liquid crystal cells selected by a scan pulse, and then controls transmittance of light supplied from a backlight assembly according to arrangement angles of corresponding liquid crystals to display an image.

Here, the source voltage is a data signal of the liquid crystal display device, and brightness of light emitted by the liquid crystal cells varies depending on the magnitude of the source voltage.

The source voltage is supplied from a source driver (data driver) and is output from a source amplifier (SAP) provided in an output terminal of the source driver to be supplied to a data line.

However, the rising slope of the source voltage output from the source amplifier is controlled by a source amplifying register (SAP register). The source amplifying register is a register which controls the output of the source amplifier. More specifically, the source amplifying register controls the output of the source amplifier depending on a preset source amplifying set value (SAP value).

In particular, in a conventional liquid crystal display device, driven at room temperature, the source amplifying register controls the output of the source amplifier corresponding to a preset source amplifying set value such that a source on-time for the liquid crystal cells can emit as much light having brightness corresponding to the source voltage as can be secured. For example, the source amplifier may register level 3 or level 4 source amplifying set values from among source amplifying set values between, for example, level 1 and level 5, and control the output of the source amplifier corresponding thereto.

Here, the source on-time means time taken to raise the source voltage to the voltage of the corresponding data and then to maintain the voltage.

If the source-on time described above is long, the liquid crystal cells may sufficiently represent the brightness corresponding to their relevant data, while power consumption increases as the source on-time becomes longer. Therefore, the source amplifying register designates a rising slope of the source voltage depending on the source amplifying set value, with a level optimized based on brightness representation and power consumption of the liquid crystal display device when driven at room temperature. Here, the source amplifying set value may be designated as a value of rising time or rising slope, and be referred to as a value designated as the rising slope of the source voltage.

However, although the source amplifying set value described above is preset, the rising slope of the source voltage output from the source driver may be varied depending on changes in ambient temperature.

More specifically, since the source amplifying set value is set based on room temperature, it cannot be controlled based on changes to ambient temperature. Therefore, when the ambient temperature of the liquid crystal display device becomes low, the mobility of a thin film transistor (hereinafter referred to as a TFT) constituting the source amplifier deteriorates to control the source amplifier depending on the fixed source amplifying set value, without reflecting the generated deterioration of the driving capability of the source amplifier. Therefore, since the rising slope of the source voltage is reduced corresponding to the reduction in power consumption generated as the ambient temperature falls, data lines and liquid crystal cells cannot be readily charged with the source voltage.

In other words, when the ambient temperature becomes low, the rising slope of the source voltage is reduced, causing the source on-time to be short, thereby causing charge errors of the source voltage from the panel, as shown in FIG. 1. Vertical line defects are thereby generated from a display unit showing an image. In FIG. 1, Vg represents scan pulse, Vc represents common voltage, and Vs represents source voltage.

In contrast, when the ambient temperature becomes high, the mobility of the TFT constituting the source amplifier increases to cause an increase in the rising slope of the source voltage, thereby causing a problem where current consumption increases.

SUMMARY OF THE INVENTION

The present invention provides a liquid crystal display device which controls a rising slope of source voltages, and a method of driving the same.

A first exemplary embodiment of the present invention provides a liquid crystal display device, including: a display unit including a plurality of liquid crystal cells at crossing regions of a plurality of data lines and a plurality of gate lines; a source driver for supplying source voltages to the plurality of data lines; and a temperature sensor for sensing an ambient temperature and for outputting an temperature sensing signal corresponding to the ambient temperature, wherein the source driver includes a source amplifying register unit for controlling a rising slope of the source voltages in accordance with the temperature sensing signal.

When the ambient temperature is lower than a reference temperature, the source amplifying register may be configured to output a source amplifying set value corresponding to an increase in the rising slope of the source voltages. When the ambient temperature is higher than a reference temperature, the source amplifying register may be configured to output a source amplifying set value corresponding to a reduction in the rising slope of the source voltages.

The source amplifying register unit may include: an analog-digital converter for converting the temperature sensing signal to a digital sensing signal; a memory for storing a reference digital value corresponding to the reference temperature; a comparator for comparing the digital sensing signal with the reference digital value and for outputting a corresponding comparative value; and a controller for outputting a source amplifying set value in accordance with the comparative value, the source amplifying set value for controlling the rising slope of the source voltages.

The controller may be configured to output a source amplifying set value corresponding to an increase in the rising slope of the source voltages when the comparative value is lower than the reference temperature, and wherein the controller may be configured to output a source amplifying set value corresponding to a reduction in the rising slope of the source voltages when the comparative value is higher than the reference temperature, The source driver may further include a shift register unit for generating sampling signals; a latch unit for storing data corresponding to sampling signals and for concurrently outputting previously stored data; a digital-analog converter for converting the stored data supplied from the latch unit into analog source voltages and for outputting the analog source voltages; and a source amplifying unit for adjusting the rising slope of and amplifying the analog source voltages in accordance with the source amplifying register unit, and for outputting the amplified source voltages to the plurality of data lines.

A second exemplary embodiment of the present invention provides a driving method of a liquid crystal display device, including: sensing an ambient temperature; controlling a rising slope of source voltages in accordance with the ambient temperature; and outputting the source voltages to a plurality of data lines.

A source amplifying set value which increases the rising slope of the source voltages may be generated when the ambient temperature is lower than a reference temperature. A source amplifying set value which reduces the rising slope of the source voltages may be generated when the ambient temperature is higher than a reference temperature.

The controlling the rising slope of the source voltages may include: generating a digital sensing signal corresponding to the ambient temperature; comparing the digital sensing signal with a reference digital value corresponding to a reference temperature; generating a source amplifying set value in accordance with a result of the comparison; generating the source voltages including a rising slope corresponding to the source amplifying set value; and outputting the source voltages to the plurality of data lines.

According to exemplary embodiments of the present invention, the source amplifying set value may automatically be changed according to an ambient temperature, such that the rising slope of the source voltages may be controlled. The rising slope of the source voltages output to the data lines may be substantially maintained irrespective of the ambient temperature. Accordingly, exemplary embodiments of the present invention may prevent or reduce vertical line defects at low ambient temperatures and increase power consumption at high ambient temperatures.

BRIEF DESCRIPTION OF THE DRAWINGS

These and/or other aspects and features of the invention will become apparent and more readily appreciated from the following description of the preferred embodiments, taken in conjunction with the accompanying drawings of which.

DETAILED DESCRIPTION OF EXEMPLARY EMBODIMENTS

Hereinafter, certain exemplary embodiments according to the present invention will be described with reference to the accompanying drawings.

Figure 1:
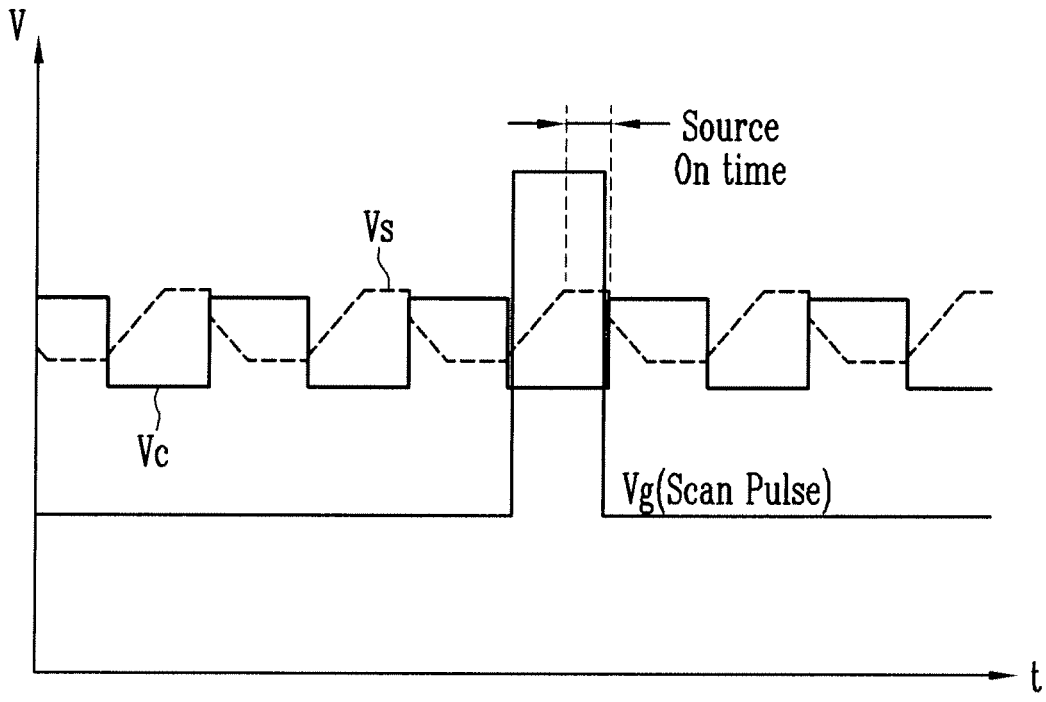
FIG. 1 is a graph showing output waveforms of source voltage, common voltage, and scan pulse at low temperature.
Figure 2:
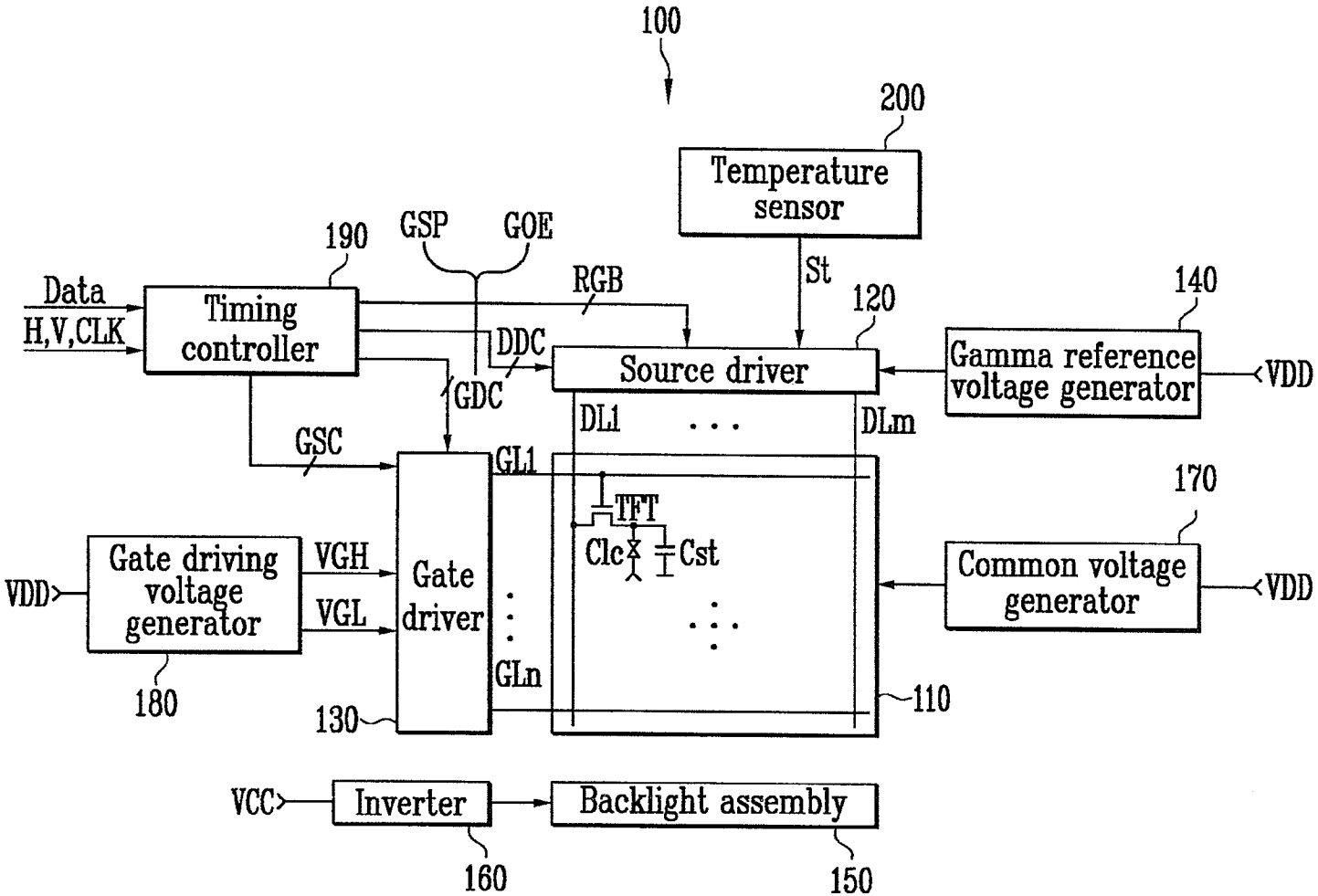
FIG. 2 is a schematic block diagram showing a configuration of a liquid crystal display device according to an exemplary embodiment of the present invention.

FIG. 2 is a schematic block diagram showing a configuration of a liquid crystal display device according to an exemplary embodiment of the present invention.

Referring to FIG. 2, a liquid crystal display device according to the exemplary embodiment of the present invention includes a display unit 110, a source driver 120, a gate driver 130, a gamma reference voltage generator 140, a backlight assembly 150, an inverter 160, a common voltage generator 170, a gate driving voltage generator 180, a timing controller 190, and a temperature sensor 200. Here, the temperature sensor 200 is not always provided within the liquid crystal display device, but may be provided in, for example, a cellular phone set on which the liquid crystal display device 100 may be mounted.

The display unit 110 includes a plurality of liquid crystal cells positioned at crossing regions of data lines DL1 to DLm and gate lines GL1 to GLn. Here, the liquid crystal cells represent pixels, including a liquid crystal capacitor Clc having upper/lower substrates of a liquid crystal display panel (i.e., a common electrode and a pixel electrode formed on the upper/lower substrates) and a liquid crystal layer interposed therebetween.

The liquid crystal cells have a thin film transistor (hereinafter referred to as a TFT) formed at crossing regions of the data lines DL1 to DLm and the gate lines GL1 to GLn, a storage capacitor Cst coupled between a TFT and constant power supply, and a liquid crystal capacitor Clc coupled between a pixel electrode coupled to the TFT and a common electrode for supplying common voltage. Here, the liquid crystal capacitor Clc includes the pixel electrode and the common electrode, and the liquid crystal layer interposed therebetween.

The TFT supplies a source voltage (that is, a data signal) from a data line DL corresponding to a scan pulse supplied from a gate line GL to the pixel electrode. To this end, the gate electrode of the TFT is coupled to the gate line GL, the source electrode is coupled to the data line DL, and the drain electrode is coupled to the pixel electrode of the liquid crystal capacitor Clc and the storage capacitor Cst. In other words, if the TFT is turned on in accordance with a scan pulse, the source voltage is supplied to the pixel electrode. Accordingly, an electric field corresponding to the source voltage is formed between the pixel electrode and the common electrode and an arrangement angle of the liquid crystal layer is varied, thereby displaying an image on the display unit 110.

The source driver 120 supplies the source voltage to the data lines DL1 to DLm corresponding to digital video data RGB and data driving control signals DDC supplied from the timing controller 190. More specifically, the source driver 120 latches the digital video data RGB supplied from the timing controller 190 by performing sampling thereon, and then converts them to analog source voltages that may represent gray levels in the liquid crystal cells of the liquid crystal display panel 110 based on the gamma reference voltage supplied from the gamma reference voltage generator 140. Then, the source driver 120 amplifies and supplies the analog source voltages to the data lines DL1 to DLm. To this end, the source driver 120 has a source amplifier (hereinafter referred to as an SAP unit (not shown)) in its output terminal.

In the present invention, a rising slope of the source voltages output from the SAP unit is controlled corresponding to the temperature sensing signal St output from the temperature sensor 200. As a result, the source voltages output to the data lines DL1 to DLm may be set within a substantially constant range, irrespective of the ambient temperature.

The gate driver 130 generates scan pulses (that is, gate pulses) in sequence corresponding to gate driving control signals GDC supplied from the timing controller 190 and applies the scan pulses to gate lines GL1 to GLn. At this time, the gate driver determines high-level voltages and low-level voltages of the scan pulses, respectively, according to a gate high voltage VGH and a gate low voltage VGL supplied from the gate driving voltage generator 180.

The gamma reference voltage generator 140 generates a positive polarity gamma reference voltage and a negative polarity gamma reference voltage by receiving high potential power supply voltage VDD, and supplies them to the source driver 120.

The backlight assembly 150 is disposed at the rear side of the liquid crystal display panel 110 and emits light by a driving voltage and/or a driving current supplied from the inverter 160 to irradiate light to the liquid crystal cells of the liquid crystal display panel 110.

The inverter (backlight driver) 160 generates a driving voltage and/or a driving current for driving the backlight assembly 150, and supplies them to the backlight assembly 150. For example, the inverter 160 converts a square wave signal into a triangle wave signal and compares the triangle wave signal with direct current power supply voltage VCC supplied from the system, so that the inverter 160 may generate a burst dimming signal in proportion to the comparative result. If the burst dimming signal is generated, a driving IC (not shown) controlling the generation of alternating current voltage and current in the inverter 160 controls the alternating current voltage and the current supplied to the backlight assembly 150 according to the burst dimming signal, thereby making it possible to drive the backlight assembly 150.

The common voltage generator 170 generates a common voltage by receiving high potential power supply voltage VDD, and supplies it to a common electrode of the respective liquid crystal cells.

The gate driving voltage generator 180 generates the gate high voltage VGH and the gate low voltage VGL by receiving the high potential power supply voltage VDD, and supplies them to the gate driver 130. Here, the gate driving voltage generator 180 generates the gate high voltage VGH above a threshold voltage of the TFT provided in each liquid crystal cell, and generates the gate low voltage VGL below the threshold voltage of the TFT. The gate high voltage VGH and the gate low voltage VGL are used for determining the high-level voltages and the low-level voltages of the scan pulses generated by the gate driver 130, respectively.

The timing controller 190 supplies the digital video data RGB from a system such as a television receiver or a computer to the source driver 120. The timing controller 190 also generates the data driving control signal DDC and the gate driving control signal GDC using horizontal/vertical synchronization signals H and V and a clock signal CLK, and supplies them to the source driver 120 and the gate driver 130, respectively. Here, the data driving control signal DDC includes a source shift clock SSC, a source start pulse SSP, a polarity control signal POL, and a source output enable signal SOE, and the gate driving control signal GDC includes a gate start pulse GSP and a gate output enable signal GOE.

The temperature sensor 200 senses ambient temperature, and outputs a temperature sensing signal St corresponding thereto. The temperature sensing signal St is supplied to the source driver 120.

In the liquid crystal display device 100 described above, the source voltage and the common voltage are respectively applied to the pixel electrode and the common electrode provided in the liquid crystal cells selected by a scan pulse. An electric field is formed between the pixel electrode and the common electrode, an arrangement angle of the liquid crystal is controlled, and light transmittance supplied from the backlight assembly 150 is changed accordingly, thereby displaying an image.

Here, the angle of the liquid crystal is determined by the data signal, that is, the source voltage applied to the pixel electrode, so it is desirable that the source voltage is evenly supplied according to each gray level.

However, the driving devices of the source driver 120 may be sensitive to temperature. Therefore, the liquid crystal display device according to the present invention controls the output value of the source amplifying register unit (hereinafter referred to as SAP register unit) by sensing ambient temperature, thereby maintaining a substantially constant rising slope of the source voltages.

Figure 3:
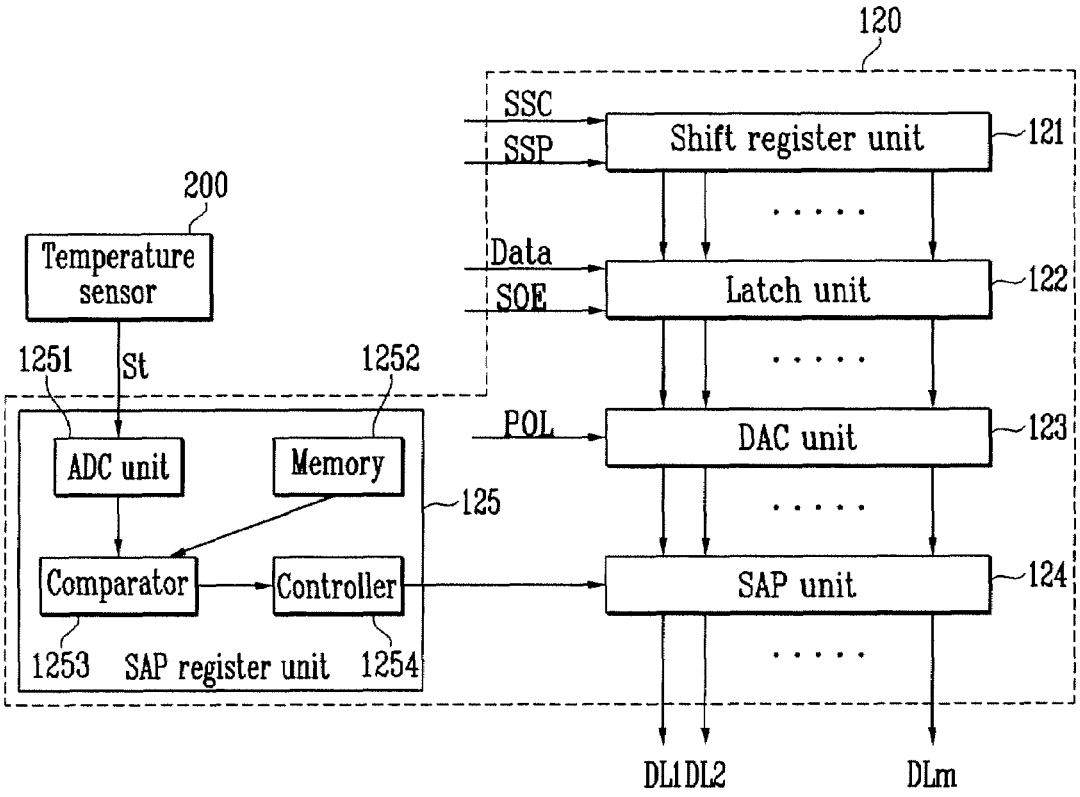
FIG. 3 is a schematic block diagram showing a configuration of a source driver according to an exemplary embodiment of the present invention.
Figure 4:
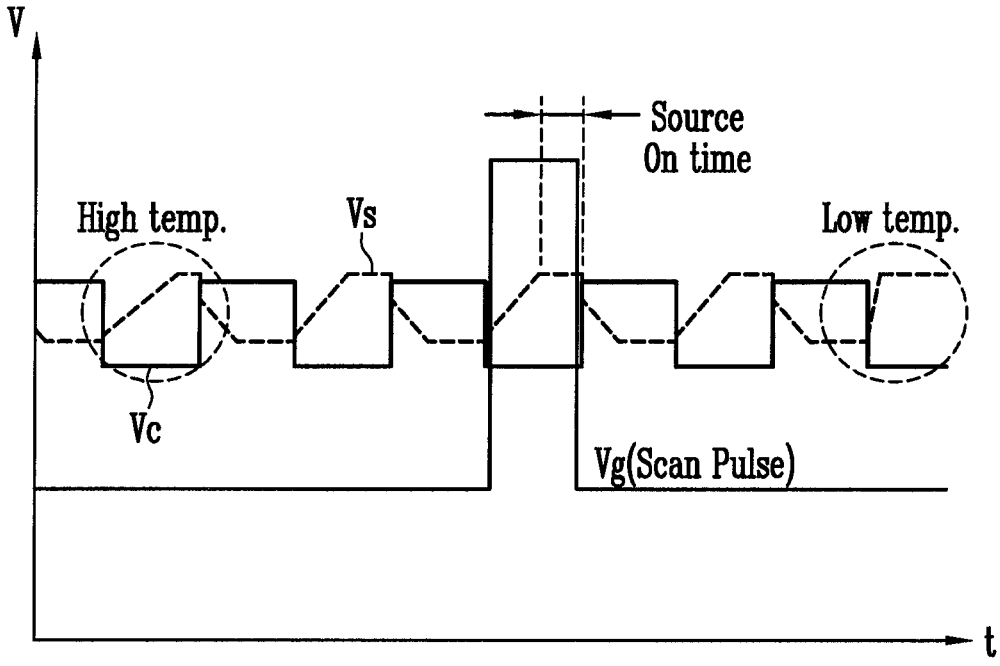
FIG. 4 is a graph showing output waveforms of source voltage, common voltage, and scan pulse at a high temperature, a low temperature, and a reference temperature.

FIG. 3 is a schematic block diagram showing a configuration of a source driver according to an exemplary embodiment of the present invention.

Referring to FIG. 3, a source driver 120 includes a shift register unit 121, a latch unit 122, a digital-analog converter (hereinafter referred to as a DAC unit) 123, an SAP unit 124, and an SAP register unit, wherein the SAP register unit 125 controls the SAP unit 124 in accordance with a temperature sensing signal St supplied from a temperature sensor 200.

The shift register unit 121 generates a sampling signal by shifting source start pulse SSP corresponding to source shift clock SSC, and supplies the generated sampling signal to the latch unit 122. To this end, the shift register unit 121 includes a plurality of shift registers provided in respective channels.

The latch unit 122 sequentially stores data Data corresponding to the sampling signals supplied from the shift register unit 121, and concurrently outputs stored data Data to the DAC unit 123 in accordance with a source output enable signal SOE. To this end, the latch unit 122 may include a plurality of sampling and holding latches provided in the respective channels.

The DAC unit 123 converts the data Data supplied from the latch unit 122 to positive polarity and/or negative polarity analog source voltages in accordance with a polarity control signal POL and outputs the analog source voltages to the SAP unit 124. To this end, the DAC unit 123 includes a plurality of digital-analog converters DAC provided in the respective channels.

The SAP unit 124 amplifies the analog source voltages supplied from the DAC unit 123 and supplies the amplified analog source voltages to the data lines DL1 to DLm. To this end, the SAP unit 124 includes a plurality of SAPs provided in the respective channels. At this time, a rising slope of the source voltages output from the SAP unit 124 is controlled according to a source amplifying set value (hereinafter referred to as an SAP set value) output from the SAP register unit 125. In other words, in exemplary embodiments of the present invention, the SAP unit 124 receives the SAP set value from the SAP register unit 125, and generates and outputs source voltages having a corresponding rising slope.

The SAP register unit 125 outputs the SAP set value to the SAP unit 124, thereby controlling the source voltages output from the SAP unit 124. In particular, the SAP set value controls the rising slope of the source voltages.

In exemplary embodiments of the present invention, the SAP register unit 125 automatically changes the SAP set value in accordance with the temperature sensing signal St supplied from the temperature sensor 200 and supplies the SAP set value to the SAP unit 124. Then, the SAP unit 124 outputs source voltages having a rising slope corresponding to the SAP set value output from the SAP register unit 125.

In other words, the SAP register unit 125 controls the rising slope of the source voltages in accordance with the temperature sensing signal St. Specifically, the SAP register 125 outputs a SAP set value corresponding to a reduction of the rising slope of the source voltages when ambient temperature is lower than a reference temperature (e.g., a preset reference temperature). The SAP register 125 outputs the SAP set value controlling the rising tilt of the source voltage to be reduced, when ambient temperature is higher than the reference temperature.

To this end, the SAP register unit 125 includes an analog-digital converter (ADC unit) 1251, a memory 1252, a comparator 1253, and a controller 1254.

The ADC unit 1251 converts the analog temperature sensing signal St supplied from the temperature sensor 200 to a digital sensing signal and supplies the digital sensing signal to the comparator 1253.

The memory 1252 stores a reference digital value corresponding to the reference temperature. Here, the reference temperature may be set to a certain temperature corresponding to room temperature or a temperature range corresponding to the room temperature.

The comparator 1253 compares the digital sensing signal supplied from the ADC unit 1251 with the reference digital value stored in the memory 1252, and outputs a comparative value corresponding to the results of the comparison. The comparative value output from the comparator 1253 is supplied to the controller 1254.

For example, after comparing the digital sensing signal with the reference digital value, the comparator 1253 may output a comparative value of 0 (or 00) if the difference between the digital sensing signal and the reference digital value is within a predetermined range. The comparator 1253 may output a comparative value of 1 (or 01) when the ambient temperature is lower than the reference temperature, and may output a comparative value of 2 (or 10) when the ambient temperature is higher than the reference temperature.

The controller 1254 maintains or changes the SAP set value (e.g., a preset SAP set value) in accordance with the reference temperature (for example, room temperature) based on the comparative value supplied from the comparator 1253 and supplies it to the SAP unit 124.

For example, when a comparative value of 0 is supplied from the comparator 1253, the controller 1254 may supply a SAP set value (e.g., the preset SAP set value) in accordance with the reference temperature to the SAP unit 124 without changing it.

When a comparative value of 1 is supplied from the comparator 1253, that is, a comparative value corresponding to a low temperature is supplied, the controller 1254 may change the SAP set value so that the rising slope of the source voltages is increased, and supply the SAP set value to the SAP unit 124. Therefore, when the ambient temperature is lower than the reference temperature, the SAP set value is changed, so that a reduction in the rising slope of the source voltages due to a decrease in mobility of the TFT is compensated. Vertical line defects on the display unit may thereby be prevented or reduced.

When a comparative value of 2 is supplied from the comparator 1253, that is, a comparative value corresponding to a high temperature is supplied, the controller 1254 may change the SAP set value so that the rising slope of the source voltages is reduced, and supply the SAP set value to the SAP unit 124. Therefore, when the ambient temperature is higher than the reference temperature, the SAP set value is changed, so that an increase in the rising slope of the source voltages due to an increase in mobility of the TFT is offset. An increase in power consumption may thereby be prevented or reduced.

In other words, the controller 1254 controls the SAP set value corresponding to the comparative value supplied from the comparative unit 1253 and supplies the SAP set value to the SAP unit 124, thereby controlling the rising slope of the source voltages output from the SAP unit 124.

The operation of controlling the rising slope of the source voltage according to an exemplary embodiment of the present invention will be briefly described. First, the temperature sensor 200 senses ambient temperature. Then, the source driver 120 controls the rising slope of source voltages in accordance with the ambient temperature sensed by the temperature sensor 200, and supplies the source voltages to the data lines DL1 to DLm.

More specifically, the source driver 120 generates a digital sensing signal corresponding to the ambient temperature. Then, the source driver 120 compares the digital sensing signal with a reference digital value corresponding to a reference temperature, and generates a SAP set value corresponding to the comparative result. The source driver 120 described above generates source voltages with rising slope corresponding to the SAP set value, and outputs the source voltages to the data lines DL1 to DLm.

At this time, if the ambient temperature is lower than the reference temperature, the source driver 120 generates a SAP set value for controlling the rising slope of the source voltages to be increased. If the ambient temperature is higher than the reference temperature, the source driver 120 generates a SAP set value controlling the rising slope of the source voltages to be reduced.

Accordingly, when the ambient temperature is lower than the reference temperature, the reduction in the rising slope of the source voltages due to the reduction in mobility of driving devices may be compensated. When the ambient temperature is higher than the reference temperature, the increase in the rising slope of the source voltages due to the increase in mobility of the driving devices may be offset.

In other words, with the present invention, the rising slope of the source voltages may be maintained, irrespective of the ambient temperature. The reliability of the liquid crystal display device may thereby be improved.

Although the exemplary embodiment of the present invention with reference to FIG. 3 describes only three cases in which the SAP value is determined, the present invention is not limited thereto. For example, the degree of increase or reduction to the SAP value may include a plurality of increments in accordance with the difference between the ambient temperature and the reference temperature, while applying the technical idea of the present invention, so that the rising slope of the source voltages may be more minutely controlled.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. A liquid crystal display device, comprising:

a display unit including a plurality of liquid crystal cells at crossing regions of a plurality of data lines and a plurality of gate lines;

a source driver for supplying source voltages to the plurality of data lines; and a temperature sensor for sensing an ambient temperature and for outputting a temperature sensing signal corresponding to the ambient temperature, wherein the source driver comprises a source amplifying register unit for controlling a rising slope, over time, of the source voltages in accordance with the temperature sensing signal, wherein the source amplifying register unit comprises:

an analog-digital converter for converting the temperature sensing signal to a digital sensing signal;

a memory for storing a reference digital value corresponding to a reference temperature;

a comparator for comparing the digital sensing signal with the reference digital value and for outputting a corresponding comparative value; and a controller for outputting a source amplifying set value in accordance with the comparative value, the source amplifying set value for controlling the rising slope of the source voltages.

2. The liquid crystal display device as claimed in claim 1, wherein the source amplifying register is configured to output a source amplifying set value corresponding to an increase in the rising slope of the source voltages when the ambient temperature is lower than a reference temperature.

3. The liquid crystal display device as claimed in claim 2, wherein an amount of increase in the rising slope of the source voltages is selected from a plurality of incremental increases in accordance with the difference between the ambient temperature and the reference temperature.

4. The liquid crystal display device as claimed in claim 1, wherein the source amplifying register is configured to output a source amplifying set value corresponding to a reduction in the rising slope of the source voltages when the ambient temperature is higher than a reference temperature.

5. The liquid crystal display device as claimed in claim 4, wherein an amount of reduction in the rising slope of the source voltages is selected from a plurality of incremental reductions in accordance with the difference between the ambient temperature and the reference temperature.

6. The liquid crystal display device as claimed in claim 1, wherein the controller is configured to output a source amplifying set value corresponding to an increase in the rising slope of the source voltages when the comparative value is lower than the reference temperature, and wherein the controller is configured to output a source amplifying set value corresponding to a reduction in the rising slope of the source voltages when the comparative value is higher than the reference temperature.

7. The liquid crystal display device as claimed in claim 1, wherein the source driver further comprises:

a shift register unit for generating sampling signals;

a latch unit for storing data corresponding to sampling signals and for concurrently outputting previously stored data;

a digital-analog converter for converting the stored data supplied from the latch unit into analog source voltages and for outputting the analog source voltages; and a source amplifying unit for adjusting the rising slope of the analog source voltages and for amplifying the analog source voltages in accordance with the source amplifying register unit, and for outputting the amplified source voltages to the plurality of data lines.

8. A method of driving a liquid crystal display device, comprising:

sensing an ambient temperature;

controlling a rising slope, over time of source voltages in accordance with the ambient temperature; and outputting the source voltages to a plurality of data lines, wherein the controlling the rising slope of the source voltages comprises:

generating a digital sensing signal corresponding to the ambient temperature;

comparing the digital sensing signal with a reference digital value corresponding to a reference temperature;

generating a source amplifying set value in accordance with a result of the comparison; and generating the source voltages including a rising slope corresponding to the source amplifying set value.

9. The method as claimed in claim 8, wherein the controlling the rising slope of the source voltages comprises generating a source amplifying set value which increases the rising slope of the source voltages when the ambient temperature is lower than a reference temperature.

10. The method as claimed in claim 8, wherein the controlling the rising slope of the source voltages comprises generating a source amplifying set value which reduces the rising slope of the source voltages when the ambient temperature is higher than a reference temperature.

11. The method as claimed in claim 8, wherein the generating the source amplifying set value comprises adjusting a source amplifying set value associated with the reference temperature in accordance with the result of the comparison.

* * * * *